US009199392B2

(12) United States Patent
Kahkonen et al.

(10) Patent No.: US 9,199,392 B2
(45) Date of Patent: Dec. 1, 2015

(54) STONE SAW

(71) Applicant: Nurmeksen Tyosto ja Tarvike Oy, Nurmes (FI)

(72) Inventors: Mika Kahkonen, Nurmes (FI); Marko Kahkonen, Nurmes (FI)

(73) Assignee: NURMEKSEN TYOSTO JA TARVIKE OY, Nurmes (FI)

( * ) Notice: Subject to any disclaimer, the term of this patent is extended or adjusted under 35 U.S.C. 154(b) by 0 days.

(21) Appl. No.: 14/190,359

(22) Filed: Feb. 26, 2014

(65) Prior Publication Data

US 2014/0238374 A1 Aug. 28, 2014

(30) Foreign Application Priority Data

Feb. 26, 2013 (FI) ..... 20134052 U

(51) Int. Cl.
*B28D 7/02* (2006.01)
*B28D 1/04* (2006.01)

(52) U.S. Cl.
CPC . *B28D 7/02* (2013.01); *B28D 1/047* (2013.01)

(58) Field of Classification Search
CPC ..... B28D 7/02; B28D 1/047; B28D 5/022; B28D 1/045; F25C 5/14
USPC ..... 451/51, 449, 377, 381; 125/13.01, 28, 125/35
See application file for complete search history.

(56) References Cited

U.S. PATENT DOCUMENTS

| | | | | | |
|---|---|---|---|---|---|
| 3,463,137 | A * | 8/1969 | Hare | 125/35 |
| 4,744,181 | A * | 5/1988 | Moore et al. | 451/39 |
| 5,799,644 | A * | 9/1998 | Nishida | 125/35 |
| 6,000,387 | A * | 12/1999 | Lee | 125/13.01 |
| 6,105,567 | A * | 8/2000 | Sun et al. | 125/13.01 |
| 6,439,218 | B1 * | 8/2002 | Hulett | 125/13.01 |
| 6,637,424 | B1 * | 10/2003 | Fuhrman et al. | 125/35 |
| 6,672,188 | B2 * | 1/2004 | Lee | 83/168 |
| 8,261,730 | B2 * | 9/2012 | Bakshi et al. | 125/16.02 |
| 8,701,646 | B2 * | 4/2014 | Boyko et al. | 125/13.01 |
| 2002/0168921 | A1 * | 11/2002 | Adachi et al. | 451/5 |
| 2007/0175466 | A1 * | 8/2007 | Kadoi | 125/13.01 |

* cited by examiner

*Primary Examiner* — George Nguyen
(74) *Attorney, Agent, or Firm* — Young & Thompson

(57) ABSTRACT

A stone saw for sawing rod-like drilling samples. The stone saw comprises a circular blade rotated by means of a rotation axle. A sample is fed against the blade and flushing fluid is sprayed on a sawing site. The stone saw further comprises collection means for collecting sawing sludge formed during sawing.

4 Claims, 2 Drawing Sheets

STONE SAW

BACKGROUND OF THE INVENTION

The invention relates to a stone saw that comprises a circular blade, against which a stone object is fed by means of a feeding device. During sawing, flushing fluid is fed to flush away the sawing sludge formed during sawing in the sawing site.

The field of the invention is described in more detail in the preamble of the independent claim of the application.

In the mining industry, there is a need to examine the mineral resources in the soil. The examination can be done by drilling holes in the rock with a sample drill that comprises a holesaw. This way, a sample that is an elongated cylindrical stone rod is detached from the rock. This sample drilling is also called rotary drilling and core drilling, and the rod-like sample is also called a drill core. The sample rod can be sawed across longitudinally so that more of the surface to be examined is revealed. A stone saw can be used to saw the sample. Typically stone saws comprise a vertical circular saw blade, against which the sample rod is fed horizontally by means of a feeding device. During sawing, flushing fluid is fed to the sawing site. However, drawbacks have been detected in the present stone sawing devices.

BRIEF DESCRIPTION OF THE INVENTION

It is an object of the present invention to provide a novel and improved stone saw.

The stone saw of the invention is characterized in that the stone saw comprises collection means for collecting the sawing sludge formed during sawing.

The idea of the present solution is that during the sawing of a sample, the formed sawing sludge is recovered. The stone saw is equipped with one or more collection means for collecting the sawing sludge.

An advantage of the present solution is that the sawing sludge formed during sawing is recovered with the collection means for further processing. This way, the sample can be utilized better than before. The sludge can be analyzed, for example, to obtain additional information on the sawed sample. Further, the sample may comprise valuable minerals, such as gold, that can now be recovered and utilized. Yet another advantage is that the mineral content in the sample can be defined exactly, when the proportion of sludge removed during sawing can be taken into consideration. This improves the exactness of the content definition especially when the sample is small in relation to the thickness of the sawing groove. Recovering the sludge and taking it into consideration in evaluating the sample thus improve the reliability of the research results.

The idea of an embodiment is that the means for collecting sawing sludge comprise one or more collection chutes that are arranged in connection with a feeding device. In addition, the collection chute is located below the sample being sawed, whereby flushing fluid fed to the sawing site can flow together with chippings into the collection chute under gravity. The collection chute is simple in structure and, thus, also reliable in operation and easy to manufacture. Gravitational sludge collection does not need any actuators or energy to operate.

The idea of an embodiment is that the collection chute, or at least its bottom, is arranged to be inclined in relation to the horizontal direction and, thus, comprises a top end and a bottom end. Sludge that has flown into the collection chute and comprises chippings and flushing fluid may flow toward the bottom end of the chute under gravity. When the sludge moves in the collection chute under gravity, the arrangement does not need any actuators or energy to operate.

The idea of an embodiment is that pressurized medium is fed into the collection chute to help the sawing sludge to move toward the discharge end of the collection chute. The medium may be pressurized air or flushing fluid, for instance. In such a case, there are one or more feed channels in connection with the collection chute for feeding the pressurized medium.

The idea of an embodiment is that at the discharge end of the collection chute suction helps the sawing sludge to move toward the discharge end of the collection chute.

The idea of an embodiment is that the feeding device comprises an elongated support element with first and second support surfaces on its top surface. The support surfaces are arranged together to form a V-shaped structure. Between the support surfaces, there are one or more flow openings, through which the sludge can flow downward. The flow opening may extend as one continuous gap and cover the entire sawing length or, alternatively, there may be several flow openings arranged at a distance from each other to cover substantially the entire sawing length. Further, the collection chute is integrated to the support element and located below said one or more flow openings.

The idea of an embodiment is that the feeding device comprises an elongated support element with first and second support surfaces on its top surface. Conveyor belts of a feed conveyor are arranged against both support surfaces. The support surfaces and conveyor belt are in the shape of a V. Between the support surfaces and conveyor belts, respectively, there is a gap that serves as a flow opening. The collection chute is in this gap. The collection chute may be inclined in relation to the horizontal direction with its inclination toward the discharge end of the collection chute.

The idea of an embodiment is that the sample to be sawed is arranged in a cassette that is moved by the feeding device in relation to a circular blade. The cassette comprises V-shaped mating surfaces, against which the sample is arranged. The bottom of the cassette has one continuous groove, or alternatively several shorter grooves, from which sawing sludge can flow away. The cassette makes it easier and faster to handle and saw the samples. In connection with the cassette, there are means for fastening the sample stationary to the cassette.

The idea of an embodiment is that the collection chute is connected to a collection device, with which sawing sludge is recovered for further processing.

The idea of an embodiment is that the collection device is a container, into which sawing sludge is recovered. The container may be easily detachable from the stone saw, in which case the sludge can be transported in the container to the further processing site. Alternatively, the container is fixed to the stone saw, in which case the container has means for discharging the collected sludge.

The idea of an embodiment is that the collection device comprises filter means, with which the flushing fluid and solids can be separated for further processing.

The idea of an embodiment is that the collection device comprises separator means, with which the mineral in the sludge can be analyzed.

The idea of an embodiment is that the collection device comprises analysis means, with which the mineral and other matter in the sludge can be separated from each other. This way, it is for example possible to separate and recover valuable minerals with the collection device.

The idea of an embodiment is that the flushing fluid is fed to the sawing site in the direction of the blade frame of the circular blade.

The idea of an embodiment is that the circular blade is fastened to the rotation axle between two blade flanges. On the outer circumference of one or both blade flanges, there are several spray openings, from which flushing fluid is fed radially. The flushing fluid is then directed in the direction of the blade frame of the circular blade to the sawing site, whereby flushing is efficient and sawing sludge flushes well to the collection means.

The idea of an embodiment is that the blade flange is an annular piece and comprises inner and outer circumferences. The blade flange also has an axial-direction support surface that may be arranged against the side of the blade disc of the circular blade. Further, the support surface has several grooves that extend from the inner circumference to the outer circumference of the blade flange and form spray channels together with the blade disc of the circular blade. Said spray channels are open on the outer circumference of the blade flange and, thus, form the spray openings, from which flushing fluid can be fed to the sawing site along the side of the blade disc of the circular blade.

The idea of an embodiment is that the stone saw is intended for sawing drill cores in soil testing. Drill cores are cylindrical stone rods that are sawed across in the longitudinal direction with a stone saw or into which one or more longitudinal saw grooves are sawed.

It should also be noted that the above-mentioned embodiments and the related features can also be combined. This way, it is possible to form for each purpose a suitable combination of the features.

BRIEF DESCRIPTION OF THE FIGURES

Some embodiments are explained in more detail in the accompanying drawings, in which.

For the sake of clarity, the figures show some embodiments in a simplified manner. In the figures, like reference numerals identify like elements.

DETAILED DESCRIPTION OF SOME EMBODIMENTS

Figure 1:
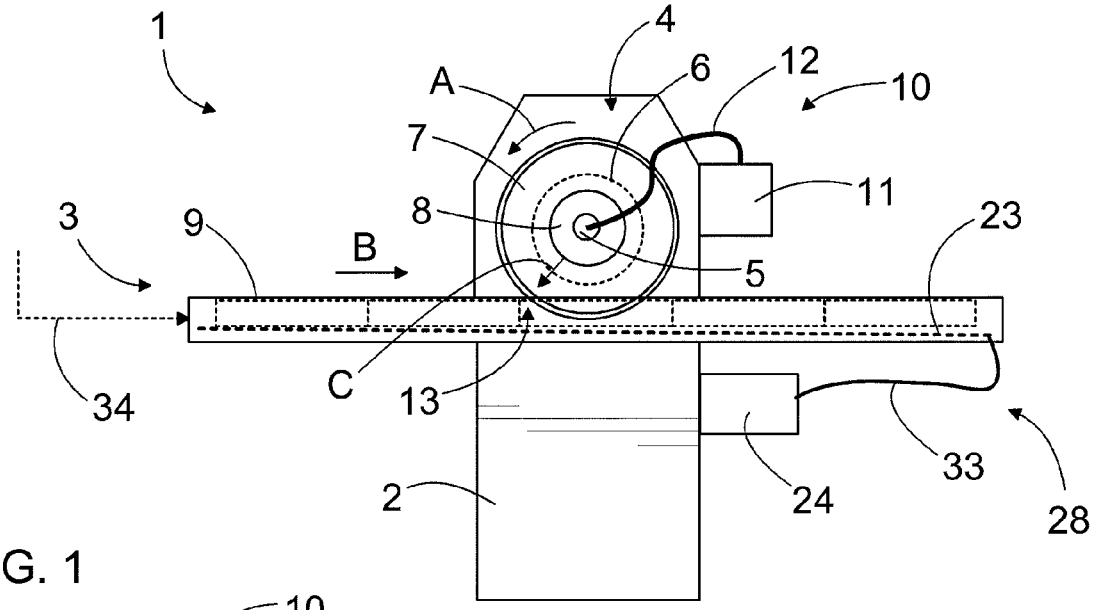
FIG. 1 is a schematic side view of a stone saw.

For the sake of clarity, FIG. 1 shows a highly simplified stone saw 1 that comprises a frame 2, feeding device 3 and sawing device 4. The sawing device 4 comprises a rotation axle 5 that is supported to the frame 2 and can be rotated A by means of a rotation device 6. A circular blade 7 can be fastened to the rotation axle 5 between blade flanges 8. A stone object to be sawed can be fastened to a fastening cassette 9 or a corresponding fastening element that can be fed B toward the rotating circular blade 7 during sawing. There may be several consecutive fastening cassettes 9 and they may be arranged on the feeding device 3 that may comprise a manual conveyance device or it may be equipped with a transfer conveyor, such as a belt conveyor. The stone saw 1 may be a horizontal machine tool, in which the rotation axle 5 and feed B are horizontal.

Further, the stone saw 1 comprises a flushing system 10 with at least one flushing unit 11, in which a required pressure is generated to the flushing fluid. The flushing unit 11 may comprise a pump for generating the required pressure and flow for the flushing fluid, which may be water, a mixture of water and one or more additives, or some other liquid. It is also possible that the flushing unit 11 comprises means for connecting to a pressure fluid network. From the flushing unit 11, the pressurized flushing fluid can be led along a feed channel 12 to the rotation axle 5 and onward along one or more axial flushing channels in the rotation axle to one or both blade flanges 8. The blade flange 8 may have crosswise channels, grooves, or the like, along which the flushing fluid can be fed crosswise to the spray openings on the outer circumference of the blade flange 8, from which the flushing fluid is sprayed C crosswise. The spray C then hits the sawing site 13 well and flushes away the matter, such as chippings and the like, detached during sawing from the sawing site and also cools the working face on the outer circumference of the circular blade 7.

FIG. 1 further illustrates in a highly simplified manner that in connection with the feeding device 3, there are collection means 28 for collecting sawing sludge. These means may comprise a collection chute 23 or a corresponding collection element that is shown by a dashed line. The collection chute 23 or at least the bottom of the chute may be arranged to be inclined toward its discharge end that is connected to a discharge channel 33. The sawing sludge collected with the discharge channel 33 may be led to a collection device 24. FIG. 1 also shows by a dashed line 34 a channel, by which flushing fluid can be led to the collection means 28, whereby with the additional feed of flushing fluid, the flowing of the sawing sludge toward the discharge end can be improved.

Figure 2:
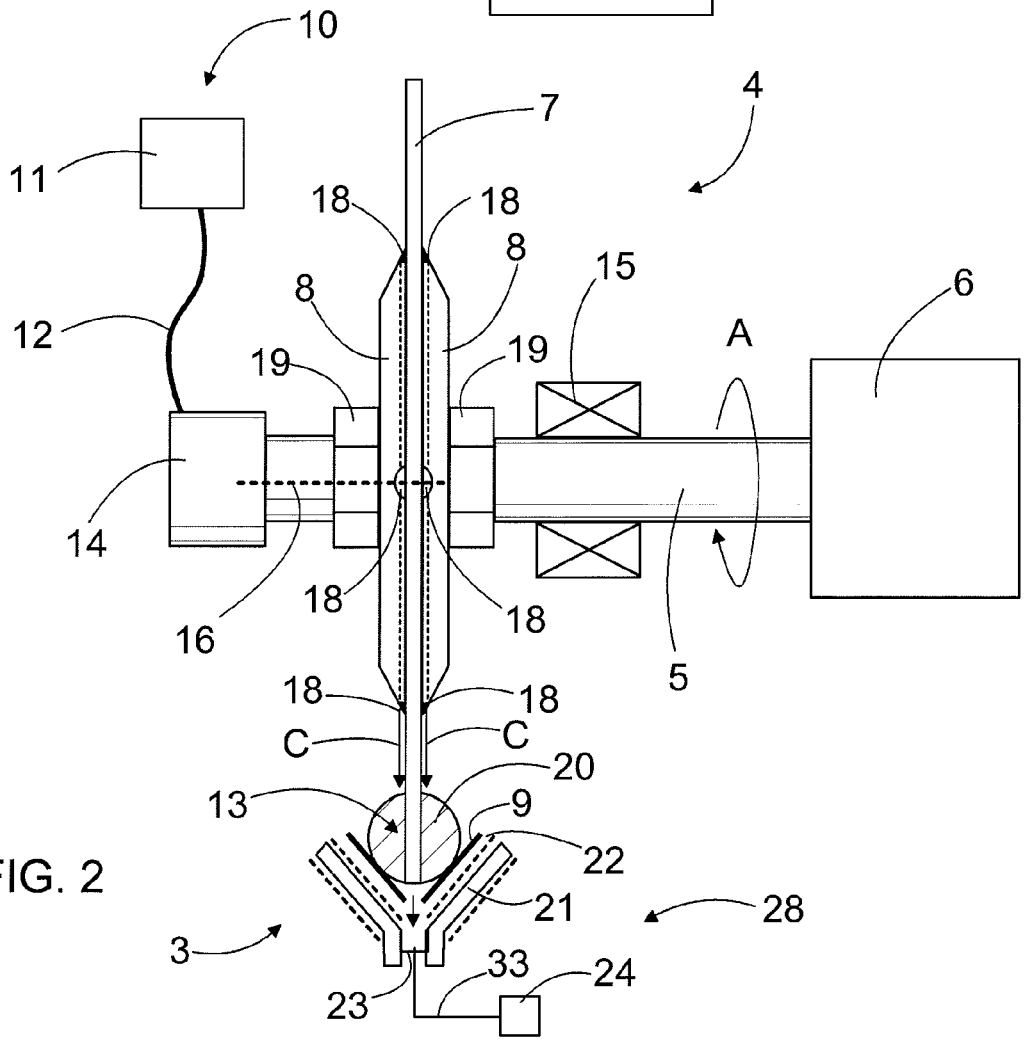
FIG. 2 is a schematic view showing a part of a stone saw as seen from the sawing direction.

FIG. 2 shows a sawing device 4 with a rotation device 6 on one end of the rotation axle 5 and a rotating connector 14 on the opposite end. Further, the rotation axle 5 is supported to the frame by a support bearing 15 on the section between its ends. The rotating connector 14 is connected to the flushing unit 11 by means of a feed channel 12. The rotating connector 14 allows the rotation axle 5 to rotate A and lead the flushing fluid to an axial flushing channel 16 on the projecting section of the rotation axle 5. The flushing fluid can flow along the flushing channel 16 to the blade flanges 8 that have crosswise flushing channels 17 extending to the outer circumference of the blade flanges 8, where they form spray openings 18. FIG. 2 shows that the blade flanges 8 can be pressed toward each other by means of nuts 19 or corresponding fastening elements.

FIG. 2 further shows in a simplified manner a stone rod 20 to be sawed and a cassette 9 with V-shaped support surfaces used to support and center the stone rod. The cassette 9 can be moved when it is supported by the feeding device 3. The feeding device 3 may have a support element 21 with conveyor belts 22 arranged against its upper surfaces. Both the bottom of the support element 21 and the bottom of the cassette 9 may have openings, from which the sawing sludge formed during sawing and flushing fluid can flow downward under gravity. On the side of the support element 21 bottom, there is a collection chute 23, into which the sludge flows and with which it can be recovered and led to a collection device 24 or container. The solid matter in the recovered sawing sludge can be separated from the flushing fluid and then examined and analyzed. This way, additional sample data is obtained from the sample. Further, the solid matter in the sawing sludge may comprise valuable minerals, such as gold, that can now be recovered and utilized.

Figure 3:
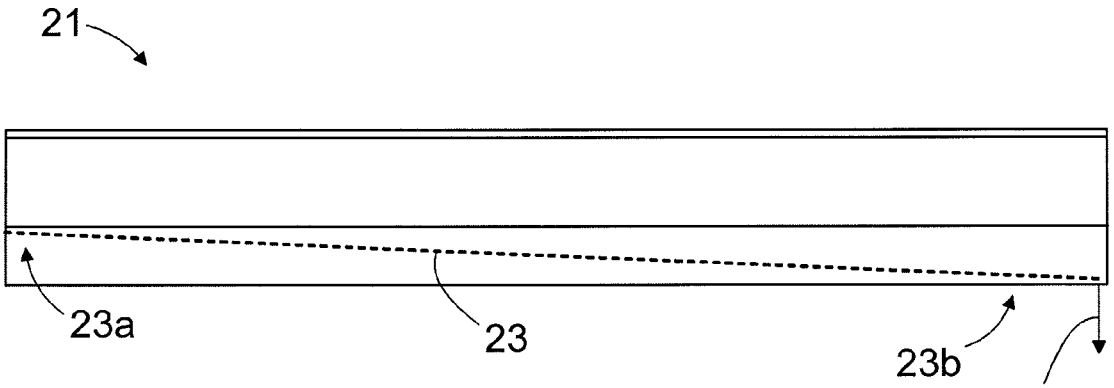
FIG. 3 is a schematic side view of a support element belonging to the feeding device and an inclined bottom of a collection chute therein.

FIG. 3 shows a support element 21 in side view. The collection chute 23 is arranged to be inclined to have a top end 23*a* and a bottom end 23*b*. This way, sawing sludge is made to move under gravity toward the bottom end 23*b* and the discharge channel 33 located there.

Figure 4:
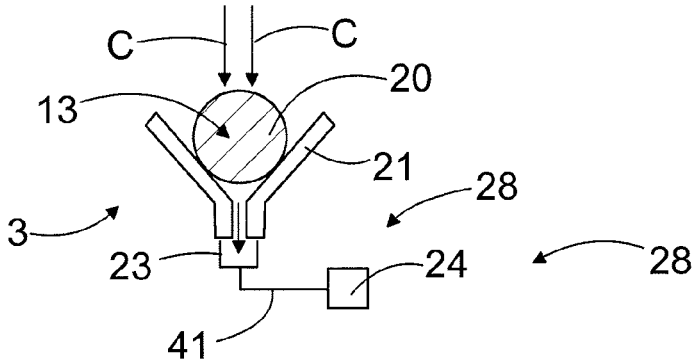
FIG. 4 is a schematic view showing a part of another feeding device as seen from the sawing direction.

FIG. 4 shows a solution, in which the collection chute is arranged against the bottom surface of the support element 21. The chute 23 is located at a gap in the support element 21. The collection chute 23 may be a separate chute-like piece bent from sheet material and fastened to the support element 21. Alternatively, the collection chute may be a separate chute-like piece with an extruded profile that is fastened to the bottom of the support element 21.

Figure 5:
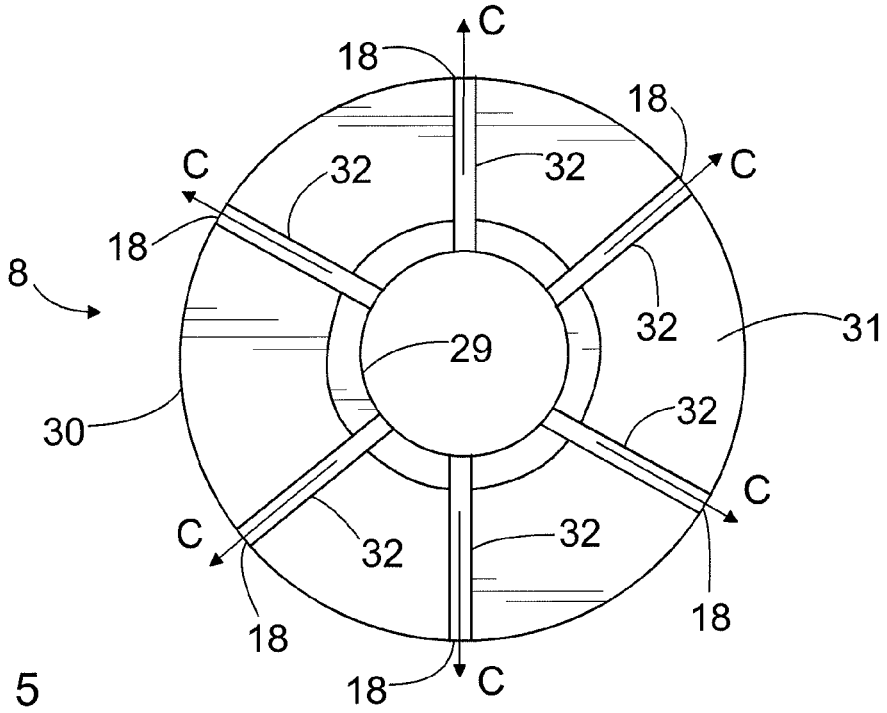
FIG. 5 is a schematic view of a blade flange and the grooves in its support surface that form radial spray channels.

FIG. 5 shows a blade flange 8 that is an annular disc and comprises an inner circumference 29 and an outer circumference 30. Further, the blade flange 8 has a support surface 31 that may be an essentially planar surface arranged against a side surface of the blade frame of the circular blade. The support surface 31 of the blade flange 8 may have radial grooves 32. The feeding of the flushing fluid can be affected by the cross-sectional shape of the grooves, the size of the cross-section, and the number and direction of the grooves.

In some cases, features disclosed in this application may be used as such, regardless of other features. On the other hand, when necessary, features disclosed in this application may be combined in order to provide different combinations.

The drawings and the related description are only intended to illustrate the idea of the invention. The details of the invention may vary within the scope of the claims.

What is claimed is:

1. A stone saw for sawing rod-like samples and comprising:

a frame;

a rotation axle;

a circular blade fastened to the rotation axle;

a rotation device for rotating the rotation axle about its longitudinal axis;

a feeding device, with which the sample to be sawed is moved in relation to the circular blade during sawing;

a flushing system for feeding pressurized flushing fluid to the sawing site;

and collection means for collecting sawing sludge formed during sawing, wherein the collection means comprise at least one collection chute that is arranged in connection with the feeding device;

and the collection chute is located below the sawing site, whereby flushing fluid fed to the sawing site is arranged to flow under gravity to the collection chute.

2. The stone saw as claimed in claim 1, wherein the collection chute is arranged to be inclined in relation to the horizontal direction and the collection chute comprises a top end and a bottom end, whereby the flushing fluid that has flown into the collection chute is arranged to flow under gravity toward said bottom end.

3. The stone saw as claimed in claim 1, wherein the collection chute is connected to a collection device, with which sawing sludge is recovered for further processing.

4. The stone saw as claimed in claim 1, wherein the feeding device comprises an elongated support element with first and second support surfaces on its top surface arranged in a V-shape in relation to each other;

between said support surfaces, there is at least one flow opening, through which the sawing sludge formed during sawing is arranged to flow downward;

and the collection chute is integrated to the support element and located below the flow opening.

* * * * *